US008698786B2

(12) United States Patent
Yamaguchi et al.

(10) Patent No.: US 8,698,786 B2
(45) Date of Patent: Apr. 15, 2014

(54) DRIVING CIRCUIT AND DRIVING METHOD FOR DISPLAY DEVICE

(75) Inventors: Shuji Yamaguchi, Kanagawa (JP); Hiroshi Takeda, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 576 days.

(21) Appl. No.: 13/005,432

(22) Filed: Jan. 12, 2011

(65) Prior Publication Data

US 2011/0169789 A1 Jul. 14, 2011

(30) Foreign Application Priority Data

Jan. 13, 2010 (JP) ..... 2010-005127

(51) Int. Cl.
*G09G 5/00* (2006.01)

(52) U.S. Cl.
USPC ..... 345/204; 345/87; 345/690

(58) Field of Classification Search
USPC ..... 345/76–100, 204, 690
See application file for complete search history.

(56) References Cited

U.S. PATENT DOCUMENTS

| | | | | |
|---|---|---|---|---|
| 7,224,340 | B2 | 5/2007 | Pai et al. | |
| 7,782,310 | B2 * | 8/2010 | Wang | 345/204 |
| 8,089,444 | B2 * | 1/2012 | Kim et al. | 345/90 |
| 8,149,229 | B2 * | 4/2012 | Lee | 345/204 |
| 2002/0003523 | A1 | 1/2002 | Pai et al. | |

FOREIGN PATENT DOCUMENTS

| | | | |
|---|---|---|---|
| JP | H04116588 | A | 4/1992 |
| JP | H08314421 | A | 11/1996 |
| JP | H09198014 | A | 7/1997 |
| JP | 2004085891 | A | 3/2004 |
| JP | 2006011286 | A | 1/2006 |
| JP | 3798269 | B2 | 4/2006 |
| JP | 2006308899 | A | 11/2006 |
| JP | 2006308900 | A | 11/2006 |
| JP | 2011081246 | A | 4/2011 |

OTHER PUBLICATIONS

Office Action issued by Japanese Patent Office in corresponding Japanese Patent Application No. 2010005127 dated Oct. 1, 2013.

* cited by examiner

*Primary Examiner* — Jennifer Nguyen
(74) *Attorney, Agent, or Firm* — Sughrue Mion, PLLC

(57) ABSTRACT

A gate start pulse signal for a next frame is output at (m−n+k+1)-th line from a beginning of display period for a previous frame in a case where m denotes the number of the display lines, n denotes the number of extra outputs from the gate driver at a side from which the scan is performed, k denotes a positive integer, and a scan of a gate driver is performed from a side at which there is an extra output from the gate driver; k pulses of gate driver clock signals are output during a vertical blank period; and input of a gate driver clock signal is restarted from a beginning of a display period for the next frame.

5 Claims, 11 Drawing Sheets

DRIVING CIRCUIT AND DRIVING METHOD FOR DISPLAY DEVICE

REFERENCE TO RELATED APPLICATION

This application is based upon and claims the benefit of the priority of Japanese patent application No. 2010-005127, filed on Jan. 13, 2010, the disclosure of which is incorporated herein in its entirety by reference thereto.

TECHNICAL FIELD

This invention relates to a driving circuit and a driving method for a display apparatus.

BACKGROUND

There is a case in which a screen scan in a direction opposite to that of an ordinary screen scan is required in a display apparatus. For example, such screen scan is required in a case where a liquid crystal display apparatus that employs a twisted nematic (TN) liquid crystal display panel whose lower viewing angle is small is set at a position higher than eyes of the user. In order to meet such purpose and increase availability of a liquid crystal display apparatus, it is preferable to realize a screen scan not only in a direction of an ordinary screen scan but also in the opposite direction.

In order to change a scan direction in the vertical direction in a liquid crystal display apparatus whose a scan direction is changeable, it is necessary to consider the number of extra (residual) output from a gate driver and input to the gate drive a start pulse signal (hereinafter termed "gate start pulse signal") at an earlier timing than in the case of a scan in the ordinary direction by the number of extra outputs from the gate driver. The number of extra (residual) outputs from a gate driver means a number obtained by subtracting the number of display lines in the vertical direction of a liquid crystal display panel from the number of outputs from a gate driver that drives gate lines of the liquid crystal display panel.

Even when a scan is performed in the opposite direction, a video signal is input at the same timing as in the case where a scan is performed in an ordinary direction. Therefore, it is necessary to input a gate start pulse signal to a gate driver during a vertical blank period that precedes the input timing of the video signal. Since it is necessary to input a gate start pulse signal before a video signal for a concerned frame is input, generation timing of the gate start pulse signal should be set based on a frame previous to the concerned frame.

There is also a case in which a vertical blank period for a video signal input to a liquid crystal display apparatus varies per frame due to image processing of display data, resolution transformation and so on.

In a case where a scan is performed in an opposite direction and there is an extra output from a gate driver, if a vertical blank period varies, the position at which the gate start pulse signal is shifted from a proper position and a display error occurs. The reason is that the gate start pulse signal is generated based on the previous frame as described above.

A conventional driving method, in a case where a scan is performed from a side at which there is an extra output from a gate driver, is described with reference to the drawings. FIG. 9 is a timing chart illustrating a driving method of a conventional liquid crystal display apparatus. It is assumed that the liquid crystal display device comprises the structure as shown in FIG. 1 (described later on) except for a driving circuit 10.

With reference to FIG. 9, a gate driver clock signal VCK is input to the gate driver V-Dr also during a vertical blank period. A gate start pulse signal VSP is generated at a timing that precedes the beginning of a display frame by n multiples of the gate driver clock signal VCK, where m denotes the number of display lines in the vertical (V) direction, r denotes the number of pulses in the gate driver clock signal VCK during the vertical blank period, and n denotes the number of extra outputs from the gate driver. The gate start pulse signal VSP is generated at a timing that is located in a previous frame of the display frame and at (m+r−n+1)-th position from the beginning of the previous frame.

Since the gate start pulse signal VSP is input beforehand in this way, scan of extra outputs from the gate driver V-Dr is completed during the vertical blank period of the previous frame, and scan starts, at the beginning of the display frame, from an output (Gm) that is actually connected to a panel scan line.

However, according to this method, in a case where the vertical blank period varies per frame, the timing at which the gate start pulse signal VSP is generated deviates from the proper position and a display error occurs.

A conventional driving method, in a case where a vertical blank period varies, is described with reference to the drawings. FIG. 10 is a timing chart illustrating a driving method of a conventional liquid crystal display apparatus. FIG. 10 illustrates an operation in a case where a vertical blank period has been extended by one period of a gate driver clock signal VCK.

Since the timing at which a gate start pulse signal VSP is generated is determined based on the beginning of the previous frame, the timing becomes (m+r−n+1) even when the vertical blank period has varied. However, since the vertical blank period has been extended, the number of pulses in the gate driver clock signal VCK, from input of the gate start pulse signal VSP to the beginning of the display frame, increases by one. Therefore, scan starts from an output Gm-1 as the first line of the display frame. Therefore, in a liquid crystal display apparatus with a structure as shown in FIG. 1, the displayed image deviates toward the upper direction by one line.

Although a scan is not performed from a side at which there is an extra output from a gate driver, a method to avoid a display error caused by variation in the vertical blank period is described in Patent Document 1.

FIG. 11 is a timing chart illustrating a liquid crystal display module described in Patent Document 1. With reference to FIG. 11, when a driving circuit detects termination of a data enable signal DE that indicates start of a blanking period, a first start vertical signal STV1 and a second start vertical signal STV2 are set to an active state and kept in the state, for example, at a gate clock cycle C2 of a gate clock signal CPV. A gate-on enable signal OE is set to an enable state and kept in the state and transmission of the gate clock signal CPV is terminated at a gate clock cycle C3 of the gate clock signal CPV.

Under this condition, when the driving circuit detects a data enable signal that indicates termination of the blanking period, transmission of the gate clock signal CPV is restarted at a predetermined timing based on the data enable signal DE. The second start vertical signal STV 2 is set to an inactive state and the gate-on enable signal OE is set to a disenable state at a predetermined timing based on the gate clock signal CPV.

Patent Document 1

Japanese Patent No. 3798269

SUMMARY

The disclosure of the above Patent Document is incorporated herein by reference thereto. Now, the following analyses are given by the present invention.

According to a conventional technology shown in FIGS. 9 and 10, when a vertical blank period varies per frame, there is a problem that a generation position of a gate start pulse signal VSP for a gate driver V-Dr deviates and a display error occurs. Moreover, when the number of extra outputs from a gate driver V-Dr is greater than the number of gate driver clock signals VCKs during a vertical blank period, there is also a problem that a scan of extra outputs cannot be completed during the vertical blank period and such gate driver V-Dr cannot be employed.

Although the technology described in Patent Document 1 (see FIG. 11) addresses to the above problem by terminating a gate driver clock signal during a vertical blank period, generation of a gate start pulse signal is performed during the vertical blank period. In order to start a scan from a side at which there is an extra output from a gate driver using this driving method, it is necessary to input a gate start pulse signal at a timing that is advanced by the number of extra outputs and also to input a gate driver clock signal in accordance with the advanced input.

Therefore, there is also a problem that the termination period of the gate driver clock signal decreases and the tolerance in the variation of the vertical blank period decreases as the number of extra (residual) outputs from the gate driver increases. There is also a problem that it is impossible to employ a gate driver whose number of extra outputs is greater than the number of the pulses in the gate driver clock signal during the vertical blank period.

It is necessary to start a scan from a side at which there is an extra output from a gate driver in order to display with a scan whose direction is reversed in the vertical direction in a liquid crystal display apparatus in which the number of outputs from the gate driver is greater than the display resolution. In this case, a gate driver whose number of outputs is greater than the number of pulses in the gate driver clock signal during a vertical blank period cannot be employed because the displayed image deviates when a gate start pulse signal for scanning the next frame is generated during the vertical blank period.

In a case where a gate driver clock signal is generated during a vertical blank period to scan a gate driver, there occurs a problem that the number of pulses in the gate driver clock signal changes in accordance with the changes in the vertical blank period and the scan number of the gate driver deviates from the expected number, which causes a displayed image to deviate.

Therefore, there is a need in the art to provide a driving circuit and a driving method that make it possible to employ a gate driver in a display apparatus, where the number of outputs from a gate driver that drives gate lines of a display panel is greater than the number of display lines of the display panel in the vertical direction in the display apparatus, and the number of extra outputs of the gate driver is greater than the number of pulses of a gate driver clock signal that can be scanned within a vertical blank period.

According to a first aspect of the present invention, there is provided a driving circuit for a display apparatus in which the number of outputs from a gate driver that drives gate lines of a display panel is greater than the number of display lines of the display panel in the vertical direction:

a gate start pulse signal for a next frame is output at (m−n+k+1)-th line from a beginning of a display period for a previous frame where m denotes the number of the display lines, n denotes the number of extra (residual) outputs from the gate driver at a side from which the scan is performed, k denotes a positive (k≥1), and a scan of the gate driver is performed from a side at which there is an extra output from the gate driver;

k pulses of a gate driver clock signal are output during a vertical blank period; and input of a gate driver clock signal is restarted from a beginning of a display period for the next frame.

According to a second aspect of the present invention, there is provided a driving method of a display apparatus in which the number of outputs from a gate driver that drives gate lines of a display panel is greater than the number of display lines of the display panel in the vertical direction, the driving method comprises:

outputting a gate start pulse signal for a next frame at (m−n+k+1)-th line from a beginning of a display period for a previous frame where m denotes the number of the display lines, n denotes the number of extra outputs from the gate driver at a side from which the scan is performed, k denotes a positive integer, and a scan of the gate driver is performed from a side at which there is an extra output from the gate driver;

outputting k pulses of a gate driver clock signal during a vertical blank period; and restarting input of a gate driver clock signal from a beginning of a display period for the next frame.

The advantageous effects of the present invention are summarized as follows.

A driving circuit and a driving method according to the present invention make it possible to employ a gate driver in a display apparatus, where the number of outputs from a gate driver that drives gate lines of a display panel is greater than the number of display lines of the display panel in the vertical direction in the display apparatus, and the number of extra outputs of the gate driver is greater than the number of pulses of a gate driver clock signal that can be scanned within a vertical blank period.

PREFERRED MODES

Figure 1:
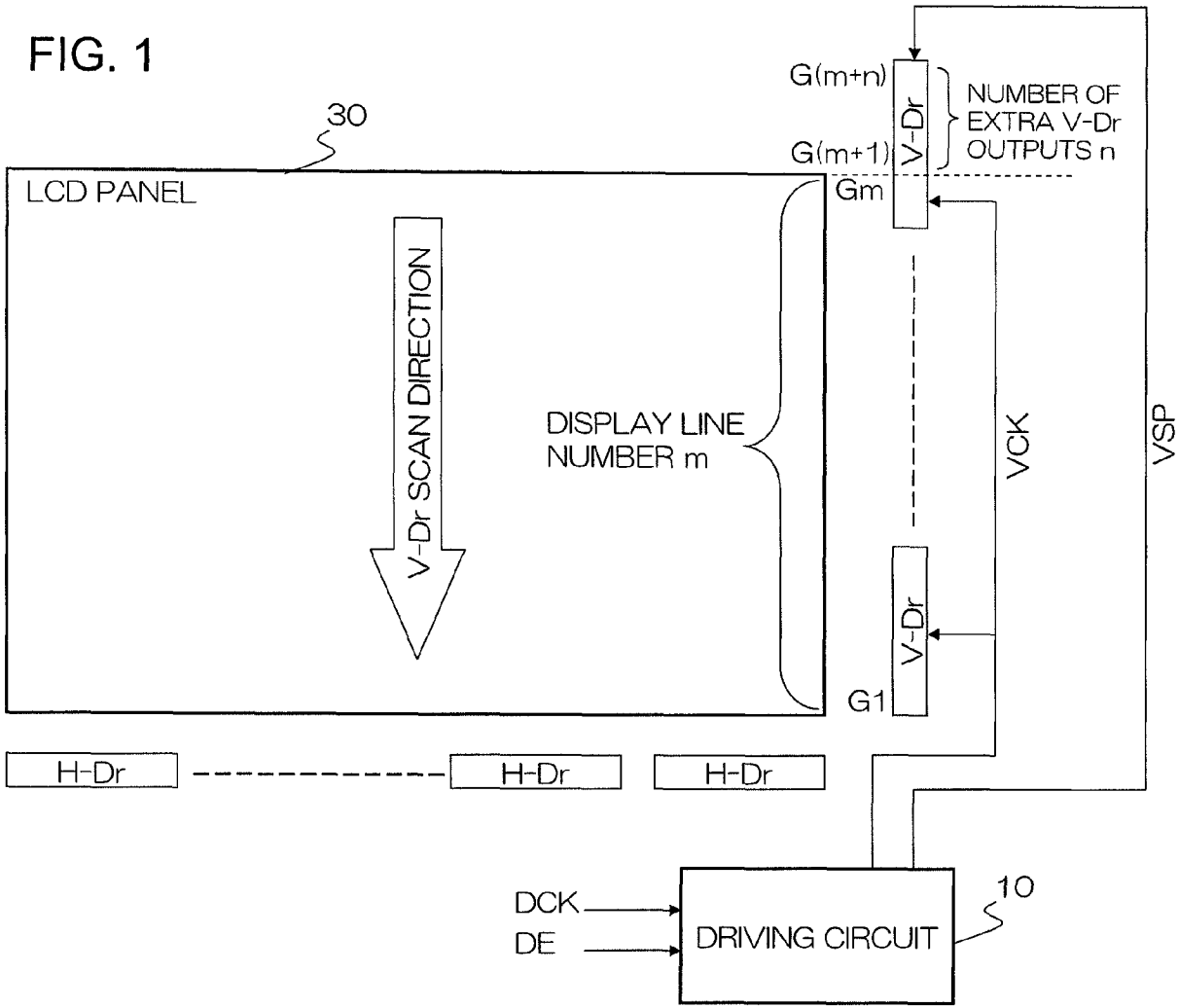
FIG. 1 is a block diagram illustrating a structure of a liquid crystal display apparatus with a driving circuit according to a first exemplary embodiment.

In the present invention, the following modes are at least possible.

In a first mode, there is provided a driving circuit according to the first aspect.

In a second mode, the gate start pulse signal is generated in response to a display data enable signal.

In a third mode, the driving circuit may comprise:

an internal reference signal generation circuit that receives a display data enable signal and generates an internal reference signal having the same period as the display data enable signal;

a V line counter that counts the number of pulses included in the internal reference signal;

a V blank decision circuit that recognizes a vertical blank period by determining whether there is the display data enable signal and generates a V blank decision signal that remains active during the vertical blank period;

a comparison unit that outputs a control signal when a count value of said V line counter reaches (m−n+k+1);

a VSP generation circuit that generates a gate start pulse signal when receiving the control signal;

a VCK termination decision circuit that causes a VCK termination signal to become active when the count value of said V line counter reaches (m+k+1) and causes the VCK termination signal to become inactive when the V blank decision signal becomes inactive; and a VCK generation circuit that generates a gate driver clock signal in response to the internal reference signal only when the VCK termination signal is inactive.

In a fourth mode, the gate start pulse signal may be generated in response to a horizontal synchronizing signal.

In a fifth mode, the driving circuit may comprise:

an internal reference signal generation circuit that receives a horizontal synchronizing signal and generates an internal reference signal having the same period as the horizontal synchronizing signal;

a V line counter that counts the number of pulses included in the internal reference signal;

a V blank decision circuit that recognizes a vertical blank period based on a count value of said V line counter and generates a V blank decision signal that remains active during the vertical blank period; a comparison unit that outputs a control signal when a count value of said V line counter reaches (m−n+k+1);

a VSP generation circuit that generates a gate start pulse signal when receiving the control signal;

a VCK termination decision circuit that causes a VCK termination signal to become active when the count value of said V line counter reaches (m+k+1) and causes the VCK termination signal to become inactive when the V blank decision signal becomes inactive; and a VCK generation circuit that generates a gate driver clock signal in response to the internal reference signal only when the VCK termination signal is inactive.

In a sixth mode, a display apparatus may comprise: a driving circuit according to the first to fifth mode; and a display panel that is driven by the driving circuit.

In a seventh mode, there is provided a driving method according to the second aspect.

In the driving circuit and driving method according to the present invention, in a case where a scan is started from a side at which there is an extra output from the gate driver, a gate start pulse signal is generated at a timing that precedes the end of the display period for the previous frame by (n−1) multiples of the gate driver clock signal, where n denotes the number of extra outputs from the gate driver.

Furthermore, after one pulse of the gate driver clock signal is generated in the vertical blank period, the gate driver clock signal is terminated until the next frame.

A driving circuit and a driving method according to the present invention make it possible, in a display apparatus in which a scan of a gate driver is performed from a side at which there is an extra output from the gate driver, to employ a gate driver whose number of extra outputs is greater than the number of pulses of a gate driver clock signal that can be scanned within a vertical blank period.

In this case, it is possible to employ a gate driver with many outputs and to realize cost reduction by reducing the number of gate drivers.

Furthermore, a driving circuit and a driving method according to the present invention prevent deviation of display images and cause a display to operate normally even when the vertical blank period varies per frame.

First Exemplary Embodiment

A driving circuit according to a first exemplary embodiment is described with reference to the drawings. FIG. 1 is a block diagram illustrating a structure of a liquid crystal display apparatus with a driving circuit according to the present exemplary embodiment. FIG. 1 illustrates a structure of a liquid crystal display apparatus in which a scan is performed from a side at which there is an extra (residual) output from the gate driver.

With reference to FIG. 1, the liquid crystal display apparatus comprises: an active matrix type liquid crystal display (LCD) panel 30; a source driver H-Dr that drives a signal line of the liquid crystal display panel 30; a gate driver V-Dr that drives a gate line of the liquid crystal display panel 30; and a driving circuit 10 that controls the source driver H-Dr and the gate driver V-Dr.

A gate start pulse signal VSP indicative of starting a scan of the gate driver V-Dr is input from a side at which there is an extra output from the gate driver V-Dr, and the gate driver V-Dr is scanned serially from the side.

Figure 2:
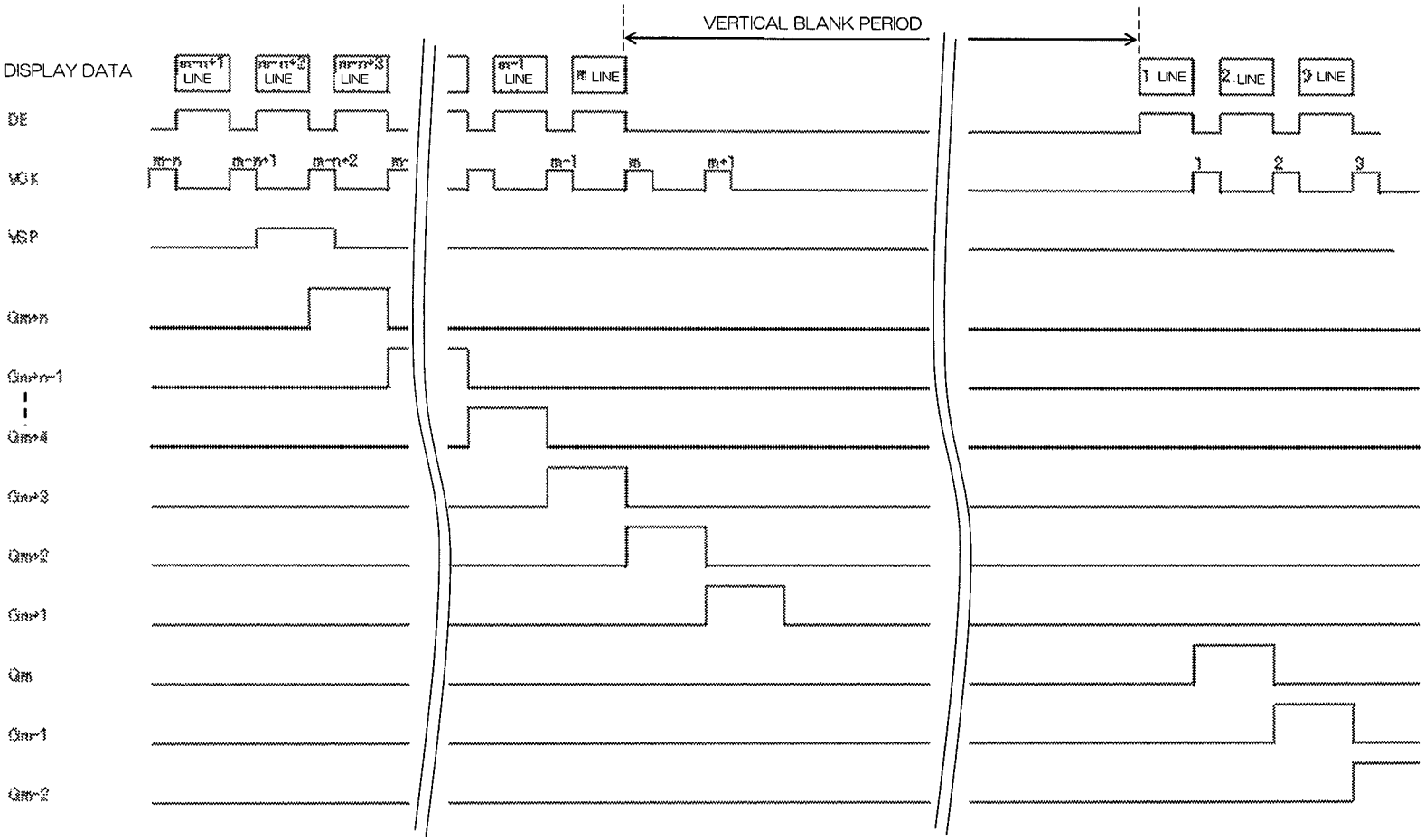
FIG. 2 is a timing chart illustrating a driving method by a driving circuit according to the first exemplary embodiment.

FIG. 2 is a timing chart illustrating a driving method by the driving circuit according to the present exemplary embodiment.

With reference to FIG. 2, a gate start pulse signal VSP for the next frame is output at (m−n+2)-th line from the beginning of a display period for the previous frame where m denotes the number of the display lines in the vertical direction, n denotes the number of extra outputs from the gate driver, and n is not less than one. After one pulse of the gate driver clock signal VCK is output, the gate driver clock signal is terminated during the vertical blank period. Input of the gate driver clock signal VCK is restarted from the beginning of a display period for the next fame.

Figure 3:
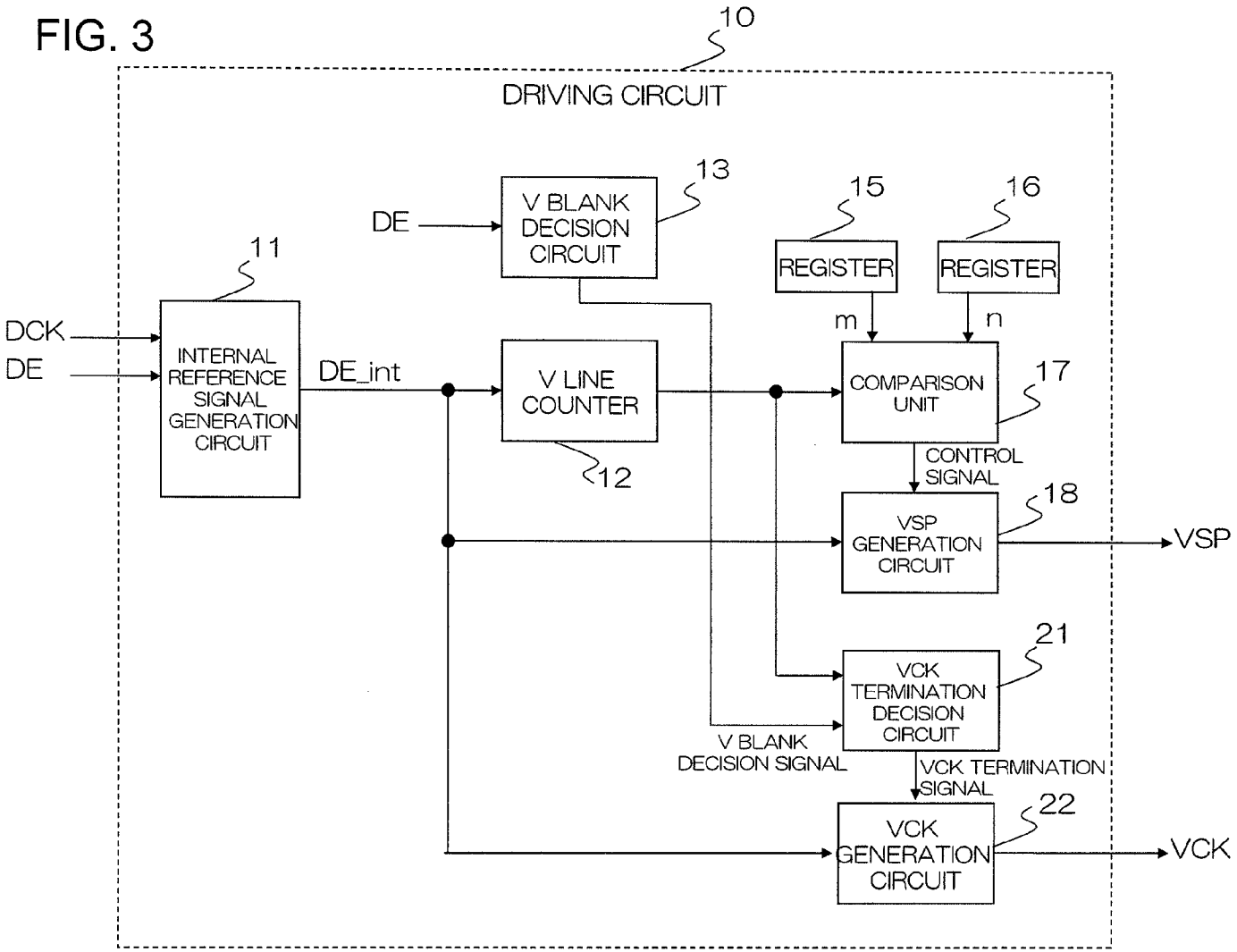
FIG. 3 is a block diagram illustrating a structure of a driving circuit according to the first exemplary embodiment.

FIG. 3 is a block diagram illustrating a structure of the driving circuit 10 according to the present exemplary embodiment. The driving circuit 10 shown in FIG. 3 realizes the driving method shown in FIG. 2.

With reference to FIG. 3, the driving circuit 10 comprises an internal reference signal generation circuit 11, a V line counter 12, a V blank decision circuit 13, registers 15, 16, a comparison unit 17, a VSP generation circuit 18, a VCK termination decision circuit 21 and a VCK generation circuit 22.

The internal reference signal generation circuit 11 receives from outside a display clock signal DCK and a display data enable signal DE, and generates an internal reference signal DE_int having the same period as the display data enable signal DE.

The V line counter 12 counts the number of pulses included in the internal reference signal DE_int.

The V blank decision circuit 13 determines whether there is the display data enable signal DE and generates as a V blank decision signal a signal that distinguishes between a display period and a vertical blank period.

The register 15 stores the number of display lines m in the vertical direction.

The register 16 stores the number of extra outputs from the gate driver V-Dr.

The comparison unit 17 compares the count value of the V line counter 12 with a value (m−n+2) determined by values m and n stored in the registers 15 and 16. When these values are equal, the comparison unit 16 outputs a control signal to the VSP generation circuit 18.

When receiving the control signal from the comparison unit 17, the VSP generation circuit 18 generates a gate start pulse signal VSP.

The VCK termination decision circuit 21 causes a VCK termination signal to become active when the count value of the V line counter 12 reaches (m+2) and causes the VCK termination signal to become inactive at a timing when the V blank decision signal output from the V blank decision circuit 13 becomes inactive (namely when the vertical blank period ends).

The VCK generation circuit 22 generates a gate driver clock signal VCK in response to the internal reference signal DE_int. The VCK generation circuit 22 causes the gate driver clock signal VCK to turn on or off in response to the VCK termination signal received from the VCK termination decision circuit 21.

In a case where a scan is performed from a side at which there is an extra output from the gate driver, a gate start pulse signal is generated during a display period for the previous frame and a scan of the extra output from the gate driver is completed during the previous frame to start a scan for an effective output from the gate driver beginning at the first scan line when a scan of the next frame is started.

Scan of the gate driver is terminated in the vertical blank period after the count value reaches (m+2) and before a scan of the next frame is started. In this case, even when the vertical blank period varies, a scan of the gate driver is not influenced by the varied period and the display operates normally from the beginning of the next frame.

Figure 4:
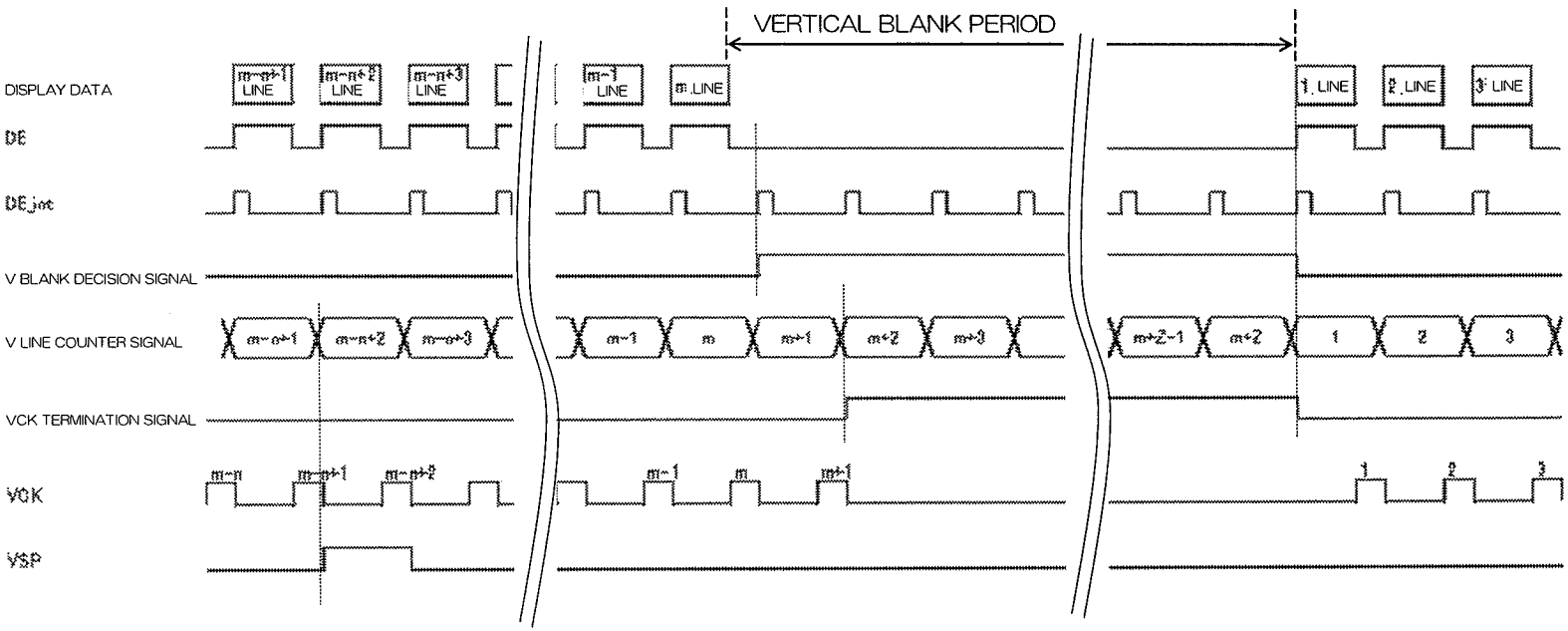
FIG. 4 is a timing chart illustrating an operation of a driving circuit of the first exemplary embodiment.

FIG. 4 is a timing chart illustrating an operation of the driving circuit 10 of the present exemplary embodiment. It is to be assumed that the number of pulses of the gate driver clock signal VCK during the vertical blank period is Z.

The internal reference signal generation circuit 11 generates in response t a display data enable signal DE an internal reference signal DE_int having the same period as the display data enable signal DE.

The V line counter 12 counts the number of pulses included in the internal reference signal DE_int.

The V blank decision circuit 13 determines whether there is the display data enable signal DE and generates as a V blank decision signal a signal that distinguishes between a display period and a vertical blank period.

The registers 15 and 16 store the number of display lines m in the vertical direction and the number of extra outputs form the gate driver V-Dr, respectively.

The comparison unit 17 refers to the registered value in the two registers 15 and 16 and the count value of the V line counter 12 and output a control signal to the VSP generation circuit 18 when the count value reaches (m−n+2).

When receiving the control signal from the comparison unit 17, the VSP generation circuit 18 generates a gate start pulse signal VSP.

The VCK termination decision circuit 21 causes a VCK termination signal to become active when the count value of the V line counter 12 reaches (m+2) and causes, in response to the V blank decision signal output from the V blank decision circuit 13, the VCK termination signal to become inactive in order to cause the VCK generation circuit 22 to restart generation of gate driver clock signal VCK.

The VCK generation circuit 22 generates a gate driver clock signal VCK in response to the internal reference signal DE_int and causes the gate driver clock signal VCK to turn on or off in response to control signal received from the VCK termination decision circuit 21.

In the present exemplary embodiment, one pulse of the gate driver clock signal VCK is output during the vertical blank period. However, the number of pulses may be an arbitrary integer not less than one. In this case, if the number of pulses in the gate driver clock signal VCK generated during the vertical blank period is denoted by k, the position at which the gate start pulse signal VSP is generated is given by (m−n+k+1).

Second Exemplary Embodiment

Figure 5:
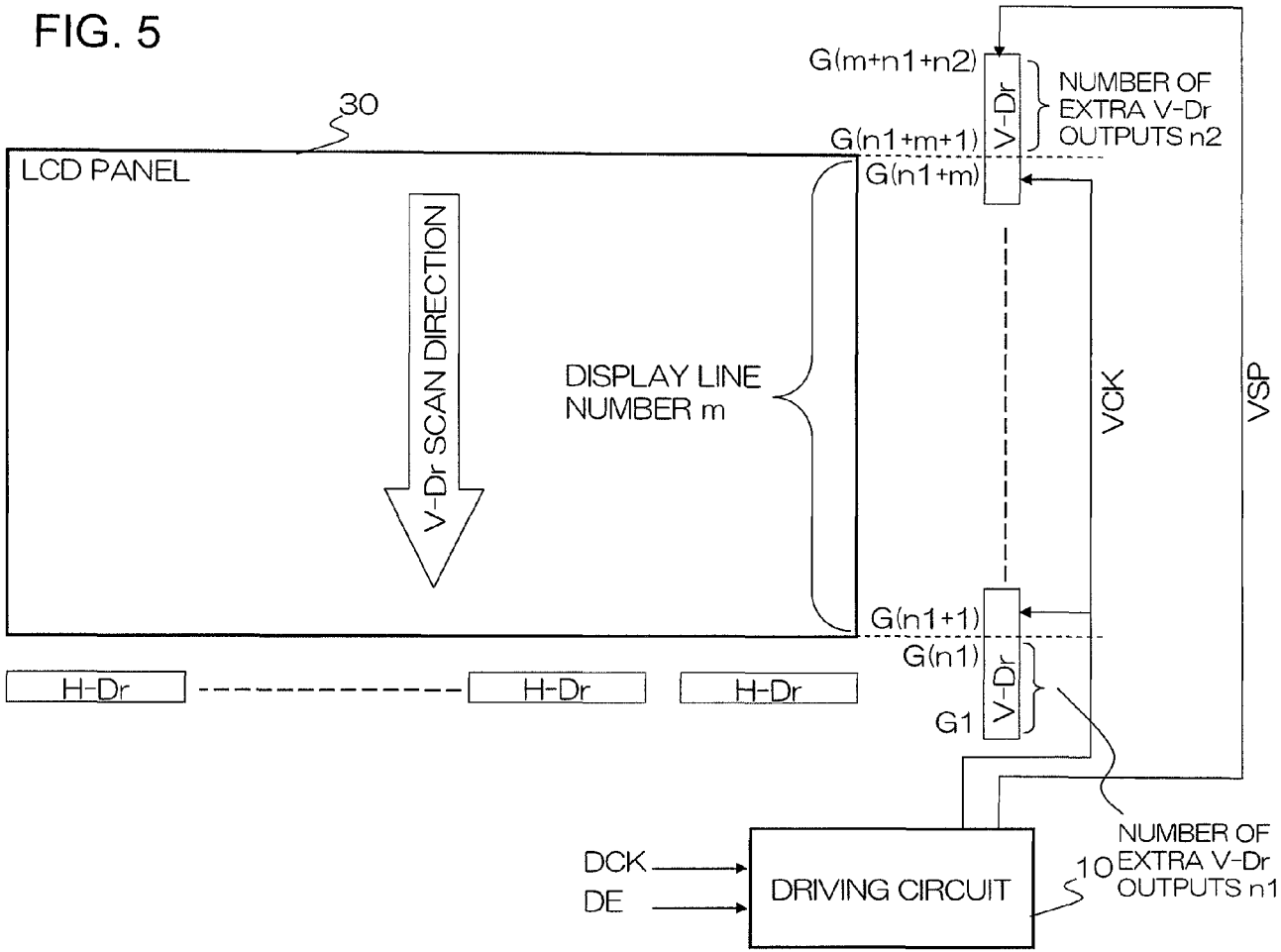
FIG. 5 is a block diagram illustrating a liquid crystal display apparatus according to a second exemplary embodiment.

A liquid crystal display apparatus according to a second exemplary embodiment is described with reference to the drawings. FIG. 5 is a block diagram illustrating a liquid crystal display apparatus according to the present exemplary embodiment. FIG. 5 illustrates an example of a structure of a liquid crystal display apparatus in which there is an extra output from the gate driver at both sides of the screen.

With reference to FIG. 5, extra outputs n1 and n2 from the gate driver V-Dr are located respectively in front and rear of the display area. In this case, in a similar manner as in the case of the above first exemplary embodiment, a gate start pulse signal VSP for the next frame is preferably output at (m−n2+2)-th line from the beginning of a display period for the previous frame.

Third Exemplary Embodiment

A driving circuit according to a third exemplary embodiment is described with reference to the drawings. A driving circuit according to the present exemplary embodiment is applicable to a liquid crystal display apparatus that operates based on an image signal in which a horizontal synchronizing signal H-Sync and a vertical synchronizing signal V-Sync are input as a reference signal.

Figure 6:
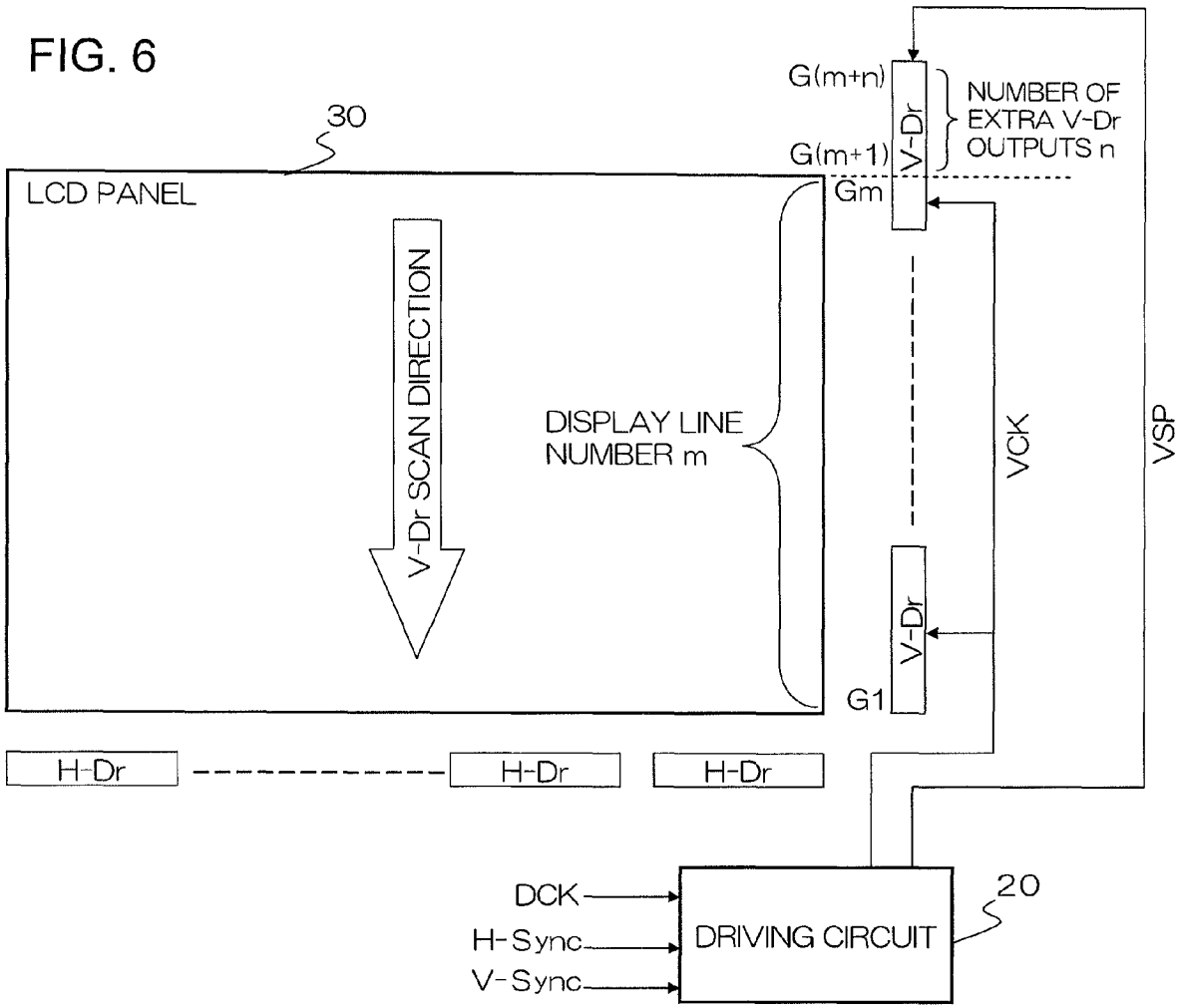
FIG. 6 is a block diagram illustrating a liquid crystal display apparatus with a driving circuit according to a third exemplary embodiment.

FIG. 6 is a block diagram illustrating a liquid crystal display apparatus with the driving circuit 20 according to the present exemplary embodiment. With reference to FIG. 6, the liquid crystal display apparatus comprises: an LCD panel 30; a source driver H-Dr that drives a signal line of the LCD panel 30; a gate driver V-Dr that drives a gate line of the LCD panel 30; and a driving circuit 20 that controls the source driver H-Dr and the gate driver V-Dr.

Figure 7:
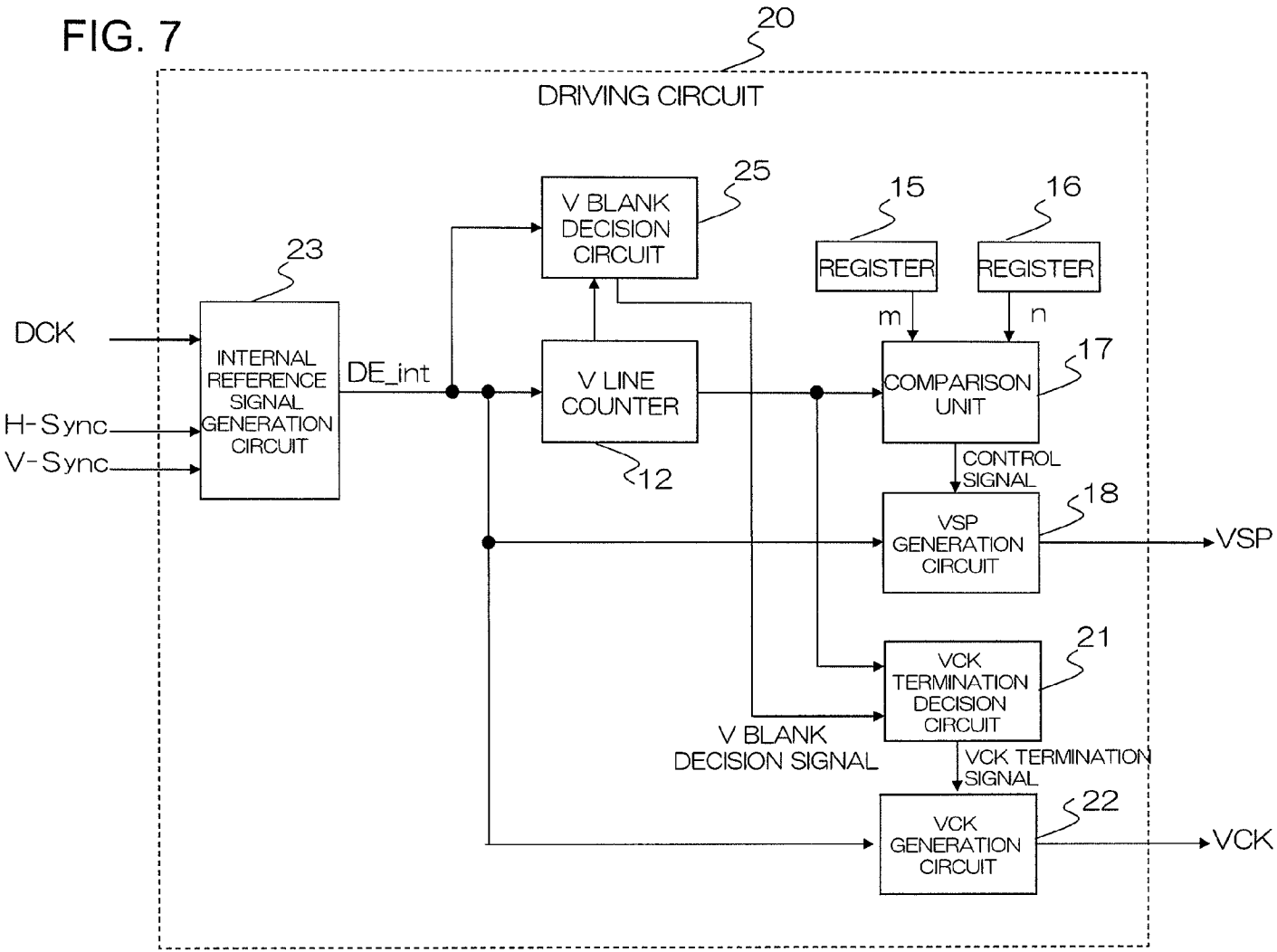
FIG. 7 is a block diagram illustrating a structure of a driving circuit according to the third exemplary embodiment.

FIG. 7 is a block diagram illustrating a structure of the driving circuit 20 according to the present exemplary embodiment. With reference to FIG. 7, the driving circuit 20 comprises an internal reference signal generation circuit 23, a V line counter 12, a V blank decision circuit 25, registers 15, 16, a comparison unit 17, a VSP generation circuit 18, a VCK termination decision circuit 21 and a VCK generation circuit 22.

The internal reference signal generation circuit 23 shifts the horizontal synchronizing signal H-Sync by a predetermined multiple of the display clock signal DCK to generate an internal reference signal DE_int that is equivalent to the internal reference signal in a driving circuit 10 of the first exemplary embodiment. In this way, the driving circuit 20 operates in a similar manner as the driving circuit 10 of the above first exemplary embodiment.

In the present exemplary embodiment, the V blank decision circuit 25 outputs a V blank decision signal that distinguishes a vertical blank period by referring to a count value of the V line counter 12.

Figure 8:
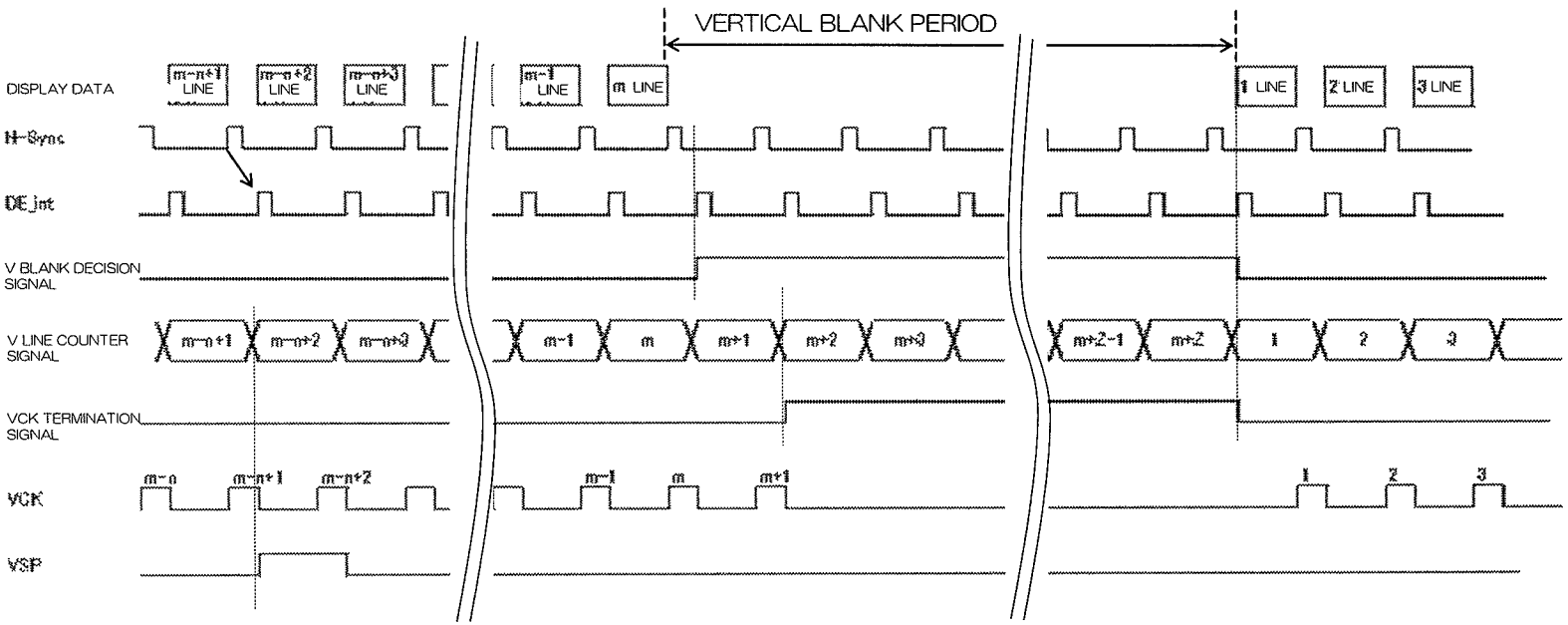
FIG. 8 is a timing chart illustrating an operation of driving circuit of the third exemplary embodiment.
Figure 9:
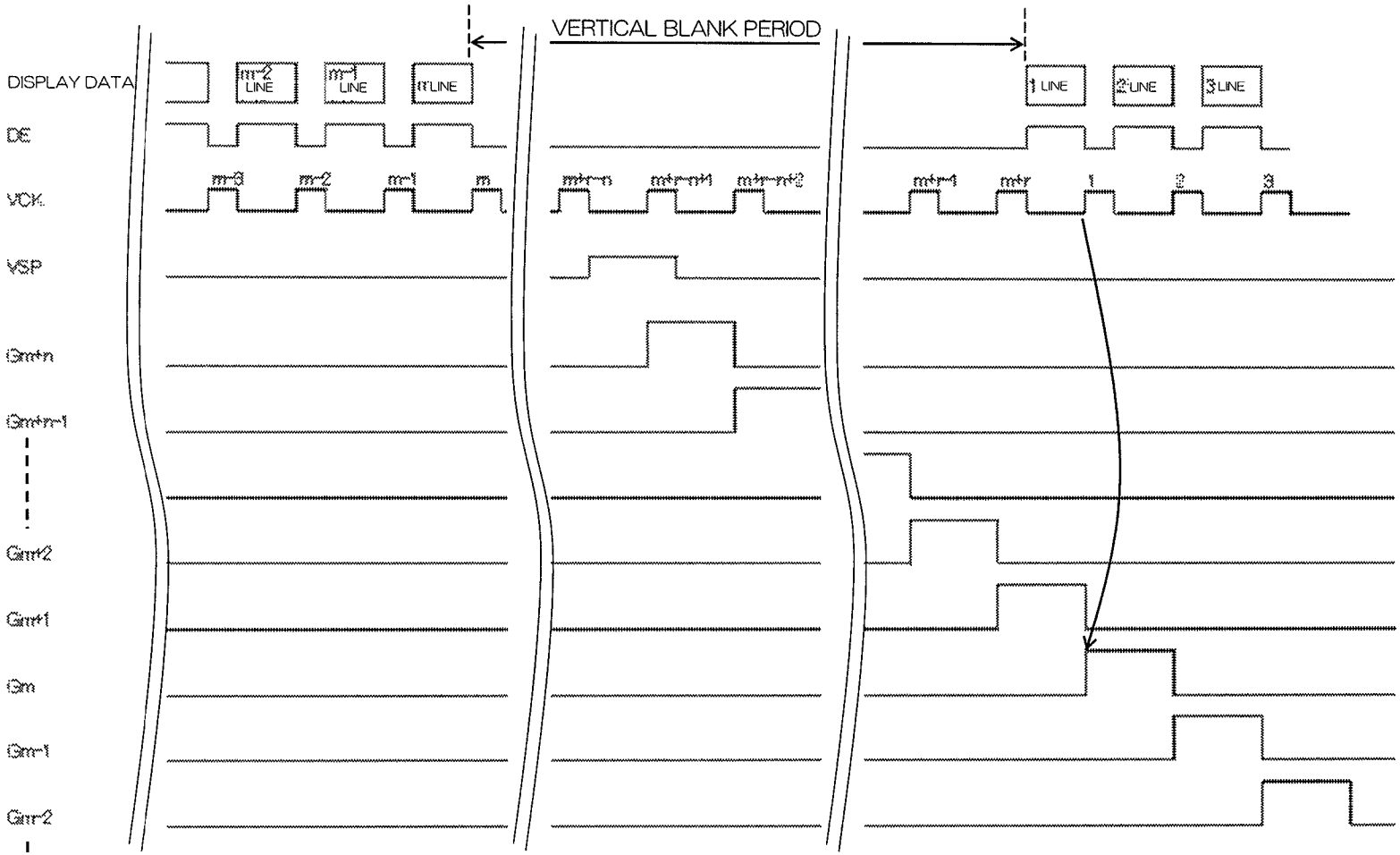
FIG. 9 RELATED ART
FIG. 9 is a timing chart illustrating a driving method of a conventional liquid crystal display apparatus.
Figure 10:
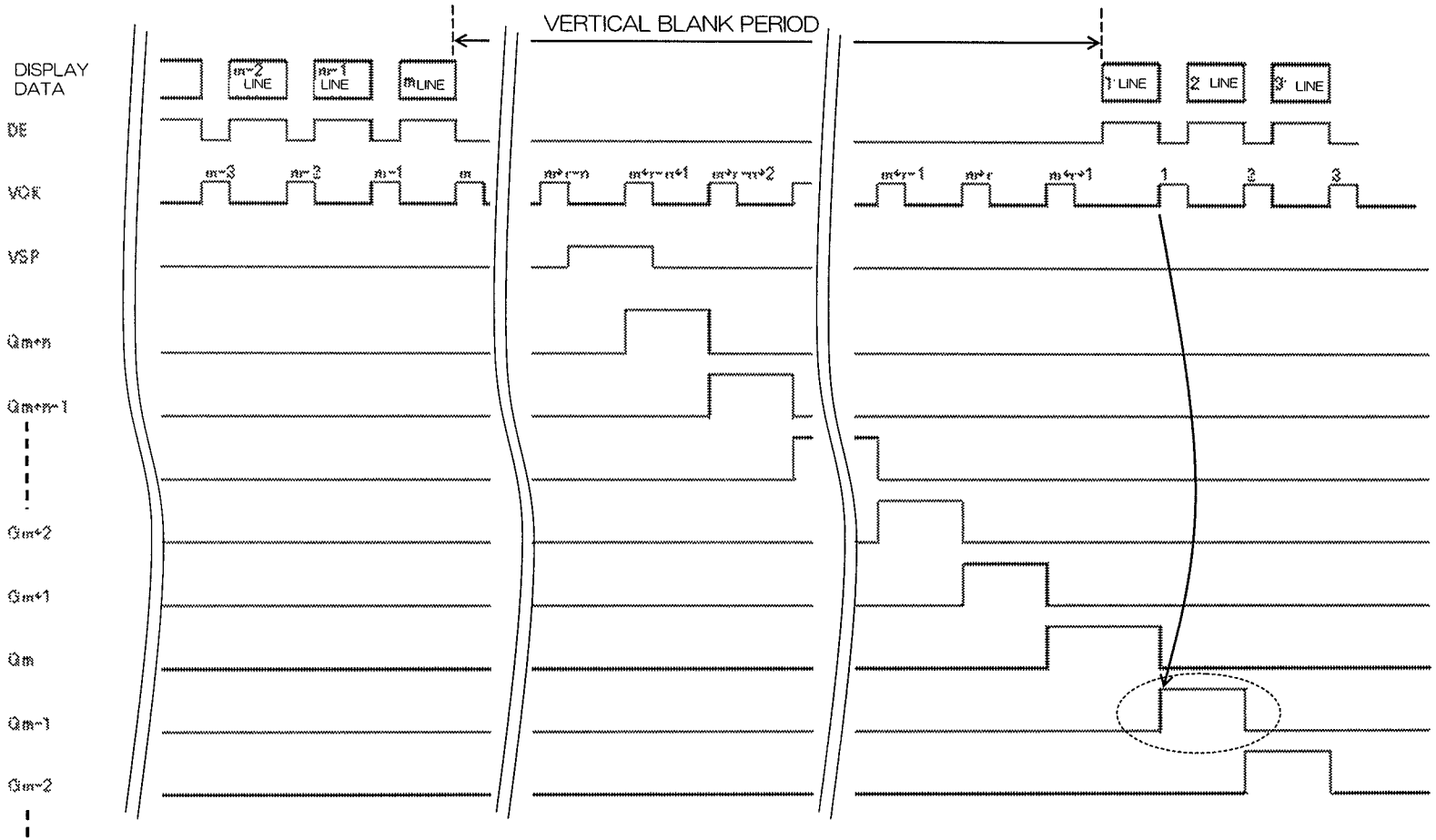
FIG. 10 RELATED ART
FIG. 10 is a timing chart illustrating a driving method of a conventional liquid crystal display apparatus.
Figure 11:
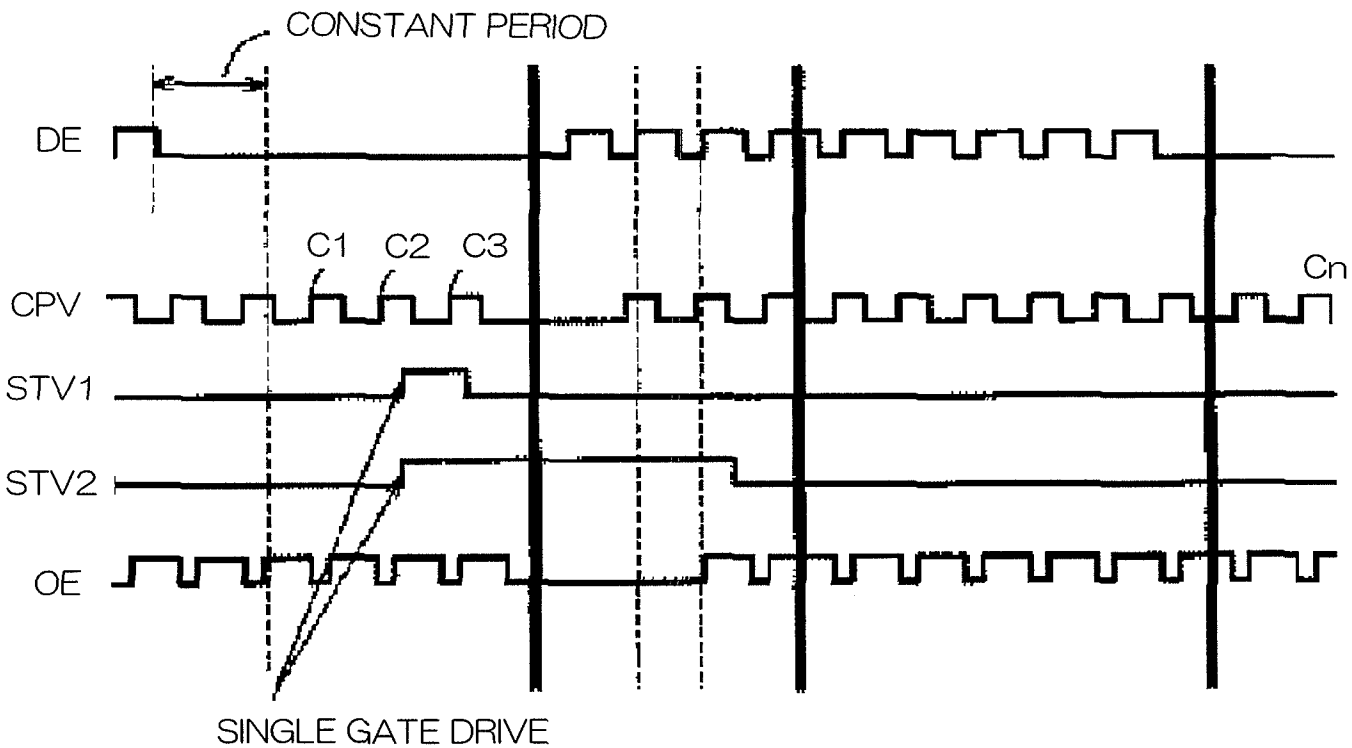
FIG. 11 PRIOR ART
FIG. 11 is a timing chart illustrating a liquid crystal display module described in Patent Document 1.

FIG. 8 is a timing chart illustrating an operation of driving circuit 20 of the present exemplary embodiment. FIG. 8 illustrates an example of generation of internal signals in a case where the driving circuit 20 operates in response to the horizontal synchronizing signal H-Sync and the vertical synchronizing signal V-Sync as shown in FIG. 7 instead of the display data enable signal DE.

The driving circuit 20 of the present exemplary embodiment operates in a similar manner as a driving circuit 10 (FIG. 3) of the above first exemplary embodiment by generating the internal reference signal DE_int from the horizontal synchronizing signal H-Sync.

A driving circuit according to the present invention makes it possible, in a display apparatus in which a scan is performed from a side at which there is an extra output from a gate driver, to employ a gate driver whose number of extra outputs is greater than the number of pulses of the gate driver clock signal that can be scanned within a vertical blank period. Therefore, use of a driving circuit according to the present invention makes it possible to employ a gate driver with high-pin-count to reduce cost. Furthermore, a driving circuit according to the present invention prevents deviation of displayed images and causes a display to operate normally even when the vertical blank period varies per frame.

In each of the above exemplary embodiments, a case in which the driving circuit is employed in a liquid crystal display apparatus is explained. However, a driving circuit according to the present invention can also be employed in a fixed pixel type display apparatus like an organic EL display apparatus and so on that comprises horizontal and vertical scan drivers and performs horizontal and vertical scans.

In the framework of entire disclosure of the present invention (including the claims), and based on its basic technological idea, exemplary embodiments or examples of the present invention may be changed and/or adjusted. Also it should be noted that in the framework of the claims of the present invention, any combinations or selections of various elements disclosed herein are possible. That is, needless to say, it is understood by those skilled in the art that various changes or modifications can be made to the present invention based on the disclosure of the present invention including the claims and the technological idea of the present invention.

What is claimed is:

1. A driving circuit for a display apparatus in which the number of outputs from a gate driver that drives gate lines of a display panel is greater than the number of display lines of the display panel in the vertical direction, wherein a gate start pulse signal for a next frame is output at (m−n+k+1)-th line from a beginning of a display period for a previous frame where m denotes the number of the display lines, n denotes the number of extra outputs from the gate driver at a side from which the scan is performed, k denotes a positive integer of at least 1, and a scan of the gate driver is performed from a side at which there is an extra output from the gate driver;

k pulses of a gate driver clock signal are output during a vertical blank period;

input of a gate driver clock signal is restarted from a beginning of a display period for the next frame; and the gate start pulse signal is generated in response to a display data enable signal, the driving circuit comprising:

an internal reference signal generation circuit that receives the display data enable signal and generates an internal reference signal having a same period as the display data enable signal;

a V line counter that counts the number of pulses included in the internal reference signal;

a V blank decision circuit that recognizes a vertical blank period by determining whether there is the display data enable signal and generates a V blank decision signal that remains active during the vertical blank period;

a comparison unit that outputs a control signal when a count value of said V line counter reaches (m−n+k+1);

a VSP generation circuit that generates a gate start pulse signal when receiving the control signal;

a VCK termination decision circuit that causes a VCK termination signal to become active when the count value of said V line counter reaches (m+k+1) and causes the VCK termination signal to become inactive when the V blank decision signal becomes inactive; and a VCK generation circuit that generates a gate driver clock signal in response to the internal reference signal only when the VCK termination signal is inactive.

2. A display apparatus comprising:

a driving circuit according to claim 1; and a display panel that is driven by the driving circuit.

3. A driving circuit for a display apparatus in which the number of outputs from a gate driver that drives gate lines of a display panel is greater than the number of display lines of the display panel in the vertical direction, wherein a gate start pulse signal for a next frame is output at (m−n+k+1)-th line from a beginning of a display period for a previous frame where m denotes the number of the display lines, n denotes the number of extra outputs from the gate driver at a side from which the scan is performed, k denotes a positive integer of at least 1, and a scan of the gate driver is performed from a side at which there is an extra output from the gate driver;

k pulses of a gate driver clock signal are output during a vertical blank period;

input of a gate driver clock signal is restarted from a beginning of a display period for the next frame; and the gate start pulse signal is generated in response to a horizontal synchronizing signal, the driving circuit comprising:

an internal reference signal generation circuit that receives the horizontal synchronizing signal and generates an internal reference signal having the same period as the horizontal synchronizing signal;

a V line counter that counts the number of pulses included in the internal reference signal;

a V blank decision circuit that recognizes a vertical blank period based on a count value of said V line counter and generates a V blank decision signal that remains active during the vertical blank period;

a comparison unit that outputs a control signal when a count value of said V line counter reaches (m−n+k+1);

a VSP generation circuit that generates a gate start pulse signal when receiving the control signal;

a VCK termination decision circuit that causes a VCK termination signal to become active when the count value of said V line counter reaches (m+k+1) and causes the VCK termination signal to become inactive when the V blank decision signal becomes inactive; and a VCK generation circuit that generates a gate driver clock signal in response to the internal reference signal only when the VCK termination signal is inactive.

4. A driving method of a display apparatus in which the number of outputs from a gate driver that drives gate lines of a display panel is greater than the number of display lines of the display panel in the vertical direction, the driving method comprises:

outputting a gate start pulse signal for a next frame at (m−n+k+1)-th line from a beginning of a display period for a previous frame where m denotes the number of the display lines, n denotes the number of extra outputs from the gate driver at a side from which the scan is performed, k denotes a positive integer of at least 1, and a scan of the gate driver is performed from a side at which there is an extra output from the gate driver;

outputting k pulses of a gate driver clock signal during a vertical blank period; and restarting input of a gate driver clock signal from a beginning of a display period for the next frame, wherein the gate start pulse signal is generated in response to a display data enable signal, and the method further comprises:

receiving the display data enable signal and generating an internal reference signal having a same period as the display data enable signal;

counting the number of pulses included in the internal reference signal;

recognizing a vertical blank period by determining whether there is the display data enable signal and generating a V blank decision signal that remains active during the vertical blank period;

outputting a control signal when a count value of the pulses of the internal reference signal reaches (m−n+k+1);

generating a gate start pulse signal when receiving the control signal;

making a VCK termination signal to become active when the count value of the pulses of the internal reference signal reaches (m+k+1) and making the VCK termination signal to become inactive when the V blank decision signal becomes inactive; and generating a gate driver clock signal in response to the internal reference signal only when the VCK termination signal is inactive.

5. A driving method of a display apparatus in which the number of outputs from a gate driver that drives gate lines of a display panel is greater than the number of display lines of the display panel in the vertical direction, the driving method comprises:

outputting a gate start pulse signal for a next frame at (m−n+k+1)-th line from a beginning of a display period for a previous frame where m denotes the number of the display lines, n denotes the number of extra outputs from the gate driver at a side from which the scan is performed, k denotes a positive integer of at least 1, and a scan of the gate driver is performed from a side at which there is an extra output from the gate driver;

outputting k pulses of a gate driver clock signal during a vertical blank period; and restarting input of a gate driver clock signal from a beginning of a display period for the next frame, wherein the gate start pulse signal is generated in response to a horizontal synchronizing signal, and the method further comprises:

receiving the horizontal synchronizing signal and generating an internal reference signal having the same period as the horizontal synchronizing signal;

counting the number of pulses included in the internal reference signal;

recognizing a vertical blank period based on a count value of the pulses of the internal reference signal and generating a V blank decision signal that remains active during the vertical blank period;

outputting a control signal when the count value of said pulses of the internal reference signal reaches (m−n+k+1);

generating a gate start pulse signal when receiving the control signal;

making a VCK termination signal to become active when the count value of said pulses of the internal reference signal reaches (m+k+1) and making the VCK termination signal to become inactive when the V blank decision signal becomes inactive; and generating a gate driver clock signal in response to the internal reference signal only when the VCK termination signal is inactive.

* * * * *